US008371017B1

(12) United States Patent
Nikkel

(10) Patent No.: US 8,371,017 B1
(45) Date of Patent: Feb. 12, 2013

(54) PANEL FASTENER HEAD ASSEMBLY AND FASTENER INSTALLATION TOOL

(76) Inventor: Robert E. Nikkel, Fort Collins, CO (US)

( * ) Notice: Subject to any disclaimer, the term of this patent is extended or adjusted under 35 U.S.C. 154(b) by 329 days.

(21) Appl. No.: 12/952,499

(22) Filed: Nov. 23, 2010

(51) Int. Cl.
*B23P 11/00* (2006.01)
*B23P 17/00* (2006.01)
*B23P 19/04* (2006.01)

(52) U.S. Cl. ..... 29/525.01; 29/525.02; 29/525.11; 29/243.5; 29/255

(58) Field of Classification Search ..... 29/243.529, 29/525.01, 525.02, 525.11, 243.5, 243.523, 29/243.53, 252, 283, 283.5
See application file for complete search history.

(56) References Cited

U.S. PATENT DOCUMENTS

| | | | | |
|---|---|---|---|---|
| 3,561,093 | A | 2/1971 | Gulistan | |
| 3,934,325 | A * | 1/1976 | Jaffe | 29/243.529 |
| 4,347,728 | A * | 9/1982 | Smith | 29/243.529 |
| 4,649,732 | A * | 3/1987 | Molina | 72/391.8 |
| 4,655,658 | A | 4/1987 | Gulistan | |
| 4,975,007 | A | 12/1990 | Molina | |
| 5,056,208 | A | 10/1991 | Stafford | |
| 5,119,665 | A | 6/1992 | Stafford | |
| 5,519,926 | A * | 5/1996 | Rosier | 29/243.523 |
| 6,732,563 | B1 * | 5/2004 | Chen | 72/391.8 |
| 7,530,155 | B1 * | 5/2009 | Nikkel | 29/524.1 |

* cited by examiner

*Primary Examiner* — David Bryant
*Assistant Examiner* — Matthew Travers
(74) *Attorney, Agent, or Firm* — Marian J. Furst

(57) ABSTRACT

An installation head for use with captive panel fasteners. The head is adapted for mounting onto a conventional fastener installation tool that can apply a predetermined outer axial compressive force distributed about a predetermined inner axial tensile force. The pulling head transfers the outer axial compressive force to an inner axial compressive force delivered to a flaring anvil, while at the same time transferring the inner axial tensile force to an outer axial tensile force delivered to an internally threaded bushing that accommodates the threaded shank of a captive panel fastener. Using the tool and the installation head to apply the predetermined axial tensile and compressive forces, captive panel fasteners can be reliably installed using a single tool stroke.

10 Claims, 6 Drawing Sheets

PANEL FASTENER HEAD ASSEMBLY AND FASTENER INSTALLATION TOOL

FIELD OF THE INVENTION

The present invention relates generally to a head assembly for use with a fastener installation tool for installing captivated fasteners onto panels, wherein the fastener has a threaded end that extends through a hole in the panel for engagement with an internally threaded opening.

BACKGROUND OF THE INVENTION

Captive panel fasteners are commonly used in applications where it is desirable to permanently attach one or more fasteners to a work piece, such as a panel that may be repeatedly removed and replaced. An example of such an application is in aircraft, where panels are routinely removed for aircraft inspection and/or maintenance and then reinstalled. In such situations, it is desirable to retain the fasteners with the panel, both to facilitate rapid re-installation of the panel and to prevent small parts, such as bolts and washers, from getting lost inside the airframe of the craft and potentially causing damage if they contact moving parts of the aircraft.

An example of a captive panel fastener 10 is shown in FIG. 1 and described in U.S. Pat. No. 4,655,658 to Bulent Gulistan, issued on Apr. 7, 1987. The fastener 10 has a head 12, a threaded shank 14, and an end 22 with an axial bore 20 extending partially through the shank 14. The shank 14 has two or more grooves 16 cut through the threads, and a washer 24 is positioned around shank 14 and has radially inwardly extending prongs 26 that are slideable within the grooves 16. The shank end 22 has a flange 18 that can be deformed, shown as 18-1 in dashed lines, to provide a stop that prevents the washer 24 from sliding off of the shank. The panel fastener can be mounted onto a panel by passing the shank 14 through a hole in the panel, placing the pronged washer 24 onto the threaded shank 14, and then deforming the flange 18 to retain the washer on the shank, with the panel between the fastener head 12 and the washer 24.

The Gulistan U.S. Pat. No. 4,655,658 also describes a tool for installing captive panel fasteners. The tool is manually operated and similar to a pair of pliers. A fastener is screwed into a cartridge mounted onto one arm of the tool, and the end of the shank is deformed as the tool handles are squeezed together. The Gulistan tool is currently used for installing captive panel fasteners by major aircraft manufacturers. However, because it is hand operated using manually applied pressure, it has several drawbacks. The larger fastener diameters and thread sizes, such as ¼-28 through ⅜-24 fasteners, require more applied pressure by the artisan to flare the end of the fastener than do smaller diameter fasteners. Repetitive motion hand and forearm injuries are common and present a safety issue. Longer handles can be added to the tool to give the artisan a greater mechanical advantage, but the longer handles prevent easy access into the airframe. The greatest drawback is that the amount of pressure is not quantified and may be inappropriate to properly upset the fastener. Further, no two fasteners are flared at the same and proper upset load, because no two artisans are able to apply equal and proper pressure by hand. Artisans who use the Gulistan tool are instructed to squeeze the handles a second time to make sure the end of the fastener is properly flared. The first time the tool is squeezed, the metal at the end of the fastener is work hardened. The second squeeze then alters the hardened portion of the fastener, which can cause the fastener to malfunction or even break.

Thus, there is a need for an improved tool for installing captive panel fasteners that uses a single, controlled application of force to properly upset each fastener. There is also a need for an improved tool that provides better access to an airframe panel or work piece.

SUMMARY OF THE INVENTION

To achieve the foregoing and other objects and in accordance with the purpose of the present invention broadly described herein, one embodiment of this invention comprises a panel fastener head assembly for installing captive panel fasteners into holes in a panel. The head assembly comprises means for transferring a predetermined outer axial compressive force to an anvil, with the anvil adapted for flaring the end of a captive panel fastener. The head assembly also comprises means for transferring a predetermined inner axial tensile force to a bushing outside of and coaxial with the anvil, with the bushing adapted for retaining a shank of a captive panel fastener. The head assembly is combinable with a fastener installation tool that has a pulling device for providing the axial tensile force and a pushing device for providing the outer axial compressive force distributed about the inner axial tensile force. The means for transferring an outer axial compressive force is slidable axially and reciprocally relative to the means for transferring an inner axial tensile force.

In the panel fastener head assembly, the anvil may have a proximal portion with at least one opening therethrough and a distal end with a flaring portion. The means for transferring the outer axial compressive force may further comprise a sleeve having a proximal end mateable with the pushing device of the installation tool, a turn nut mated with a distal end of the sleeve, and a shoulder bolt extending through openings in the turn nut and through the at least one opening of the anvil.

The means for transferring the inner tensile force may further comprise a shaft holder having a proximal end mated with the pulling device of the tool, an axial passage therethrough, and an internal shoulder extending radially inward into the passage; a shaft having a proximal end adapted for retention inside the passage of the shaft holder with the proximal end positioned proximally relative to the shoulder, the shaft also having a distal end; a forming tube extending distally from the distal end of the shaft and having a distal end and slots passing therethrough with elongations substantially parallel to the axial forces; and a socket bolt joining the forming tube to the shaft. The bushing may have a proximal end mated with the distal end of the forming tube and a distal, internally threaded end formed to accommodate the shank of a captive panel fastener.

Another embodiment of the invention comprises a tool for installing captive panel fasteners. The tool comprises means for providing a predetermined axial compressive force distributed about a predetermined inner axial tensile force; and a panel fastener head assembly for use with a fastener installation tool. The head assembly comprises means for transferring the predetermined outer axial compressive force to an anvil that is adapted for flaring the end of a captive panel fastener; and means for transferring the predetermined inner axial tensile force to a bushing outside of and coaxial with the anvil. The bushing is adapted for retaining a shank of a captive panel fastener.

The anvil may have a proximal portion with at least one opening therethrough and a distal end with a flaring portion. The means for transferring the outer axial compressive force may further comprise a sleeve having a proximal end mateable with the pushing device of the installation tool; a turn nut mated with a distal end of the sleeve; and a shoulder bolt extending through openings in the turn nut and through the at least one opening of the anvil.

In the panel fastener head assembly, the means for transferring the inner tensile force may further comprise a shaft holder having a proximal end mated with the pulling device of the tool, an axial passage therethrough, and an internal shoulder extending radially inward into the passage; a shaft having a proximal end adapted for retention inside the passage of the shaft holder with the proximal end positioned proximally relative to the shoulder, the shaft also having a distal end; a forming tube extending distally from the distal end of the shaft and having a distal end and slots passing therethrough with elongations substantially parallel to the axial forces; a socket bolt joining the forming tube to the shaft; and a bushing. The bushing has a proximal end mated with the distal end of the forming tube and a distal, internally threaded end formed to accommodate a shank of a captive panel fastener.

Yet another embodiment of the present invention comprises a method for installing a captive panel fastener into a hole passing through a panel. The method comprises the steps of providing a tool for installing captive panel fasteners. The tool comprises a panel fastener head assembly for use with a fastener installation tool, and the tool is operative to provide a predetermined outer axial compressive force distributed about a predetermined inner axial tensile force. The head assembly comprises means for transferring the outer axial compressive force to an anvil, with the anvil adapted for flaring the end of a captive panel fastener; and means for transferring the inner axial tensile force to a bushing outside of and coaxial with the anvil; the bushing adapted for retaining a shank of a captive panel fastener. In addition, the method comprises the steps of inserting a captive panel fastener shank through the hole in the panel, placing a pronged washer onto the shank, joining the panel fastener shank to the bushing, and using the tool to apply simultaneously the predetermined outer axial compressive force that is transferred to the anvil and the predetermined inner tensile force that is transferred to the bushing and panel fastener. In the method, the fastener may be installed using a single tool stroke.

In the method, the anvil may have a proximal portion with at least one opening therethrough and a distal end with a flaring portion. The means for transferring the outer axial compressive force may further comprise a sleeve having a proximal end mateable with the pushing device of the installation tool, a turn nut mated with a distal end of the sleeve, and a shoulder bolt extending through openings in the turn nut and through the at least one opening of the anvil. In this case, the using step comprises transferring the outer axial compressive force to the anvil via the sleeve, the turn nut, and the shoulder bolt.

The means for transferring the inner tensile force may further comprise a shaft holder having a proximal end mated with the pulling device of the tool, an axial passage therethrough, and an internal shoulder extending radially inward into the passage. The means for transferring the inner tensile force may additionally comprise a shaft having a proximal end adapted for retention inside the passage of the shaft holder with the proximal end positioned proximally relative to the shoulder. The shaft also has a distal end. The means for transferring the inner tensile force may further comprise a forming tube extending distally from the distal end of the shaft, with a distal end. Slots pass through the forming tube, with elongations substantially parallel to the axial forces. The means for transferring the inner tensile force may further comprise a socket bolt joining the forming tube to the shaft and a bushing. The bushing has a proximal end mated with the distal end of the forming tube and a distal, internally threaded end formed to accommodate a shank of a captive panel fastener. In this case, the using step comprises transferring the inner axial tensile force via the shaft holder, the shaft, the forming tube, the socket bolt, and the bushing.

BRIEF DESCRIPTION OF THE DRAWINGS

These and other features, aspects, and advantages of the present invention will become better understood with reference to the following description, appended claims, and accompanying drawings, where:

DESCRIPTION OF THE PREFERRED EMBODIMENT

Figure 1:
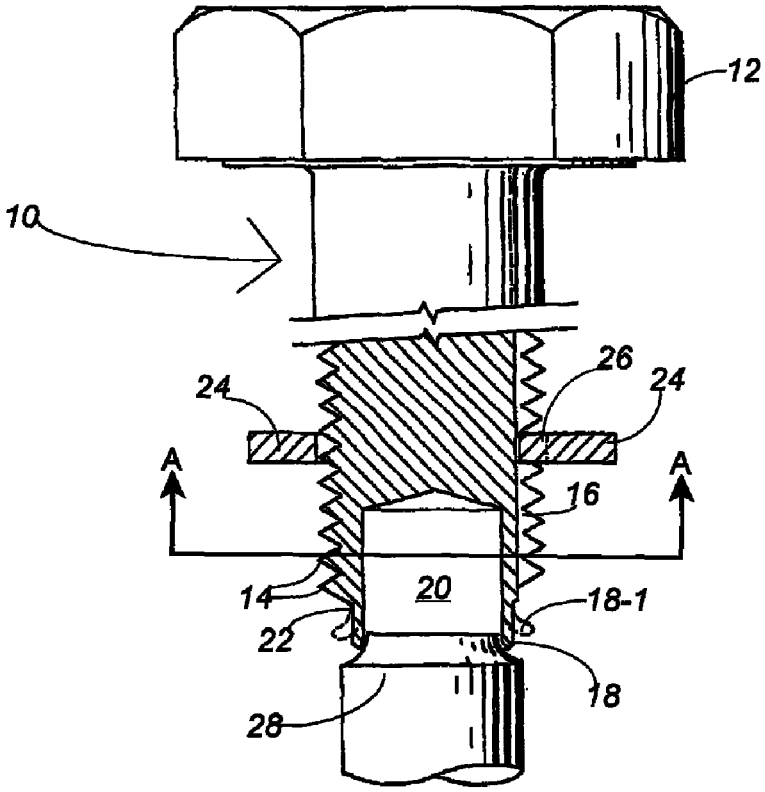
Fig. 1 Prior Art
FIG. 1 is a partial cross sectional side view of a prior art captive panel fastener and an anvil of a prior art installation tool, adapted from FIG. 1 of U.S. Pat. No. 4,655,658 to Bulent Gulistan, issued on Apr. 7, 1987.

The present invention comprises a head assembly that can be fitted to any pulling tool such as is used in the aircraft industry, such as a riveting or nut-setting tool. Such tools have a pulling device, such as a puller shaft, that applies tensile force to one part of a pulling head, and the tensile force is transferred to a fastener to be installed. The tool also includes a pushing device, such as an external portion of the tool or a tool attachment, that applies an equal compressive force to another portion of the pulling head. The combined application of tensile and compressive forces installs the fastener. Normally, the outer portion of the fastener installation head assembly applies compressive force and the inner portion applies tensile force. Such pulling tools can be set to provide the appropriate tensile and compressive forces for installation of the desired type of fastener.

As used herein, the term "proximal" refers to a portion of an object that is closer to the installation tool, and the term "distal" refers to the portion of an object that is farther away from the installation tool.

In the case of a captive panel fastener, the compressive force must be applied near the central axis of the fastener to flare the end of the fastener shaft, and at the same time the tensile force must be applied to the threads of the fastener so that the fastener is held fast while the compressive force does the flaring. The present invention provides a pulling head assembly that transfers the compressive force applied by the installation tool from the outside of the assembly at the proximal end to the inside of the assembly at its distal end. Further, the tensile force that is normally provided via interior components of the tool is transferred to the outside, distal end of the head assembly.

Referring to FIGS. 3-7, panel fastener installation head 100 comprises a sleeve 110, a turn nut 120, a shoulder bolt 140, and a threaded bushing 150, all visible from the exterior of the head. Installation head 100 also comprises internal components: a shaft holder 160, a shaft 170, a forming tube 180, a low head socket bolt 200 or other suitable fastener, and a flaring anvil 210.

Sleeve 110 has a proximal end 112 adapted for attachment to a pushing device of an installation tool and functions to transfer compressive force from the tool to the fastener end 22. As shown, proximal end 112 of sleeve 110 has external screw threads 114 that are mateable with a commercially available PT-100M air-hydraulic fastener installation tool, manufactured by Fastening Systems International, Inc., Sonoma, Calif., and shown as tool 102 in FIG. 3. Distal end 116 of sleeve 110 has a substantially smooth external surface 118 that is tapered radially inwardly.

Turn nut 120 has an outer surface 122 adapted for gripping between fingers, such as with knurls. Proximal end 124 of turn nut 120 is formed with a tapered internal surface 126 that is slidable axially relative to external surface 118 of sleeve 110. Axial bore 128 extends through turn nut 120. Opposing openings 130 and 132 extend through turn nut 120 and are sized to accommodate shoulder bolt 140 passing through the turn nut 120. Opening 130 is preferably countersunk so that shoulder bolt 140 does not protrude radially outward from the external surface of the turn nut 120. Opening 132 has internal screw threads for securing the shoulder bolt 140 to the turn nut 120.

Shoulder bolt 140 has a head 142, a shaft 144, and a threaded end 146. Head 142 is sized to fit into the countersink of opening 130 in turn nut 120 and is formed such that the bolt 140 can be screwed into or out of turn nut 120 using a conventional tool, such as a screw driver or an allen wrench. Threaded end 146 is engageable with threaded opening 132 of turn nut 120 to secure the shoulder bolt 140 into the turn nut. Preferably, the shoulder bolt head 142 is substantially flush with the outer surface 122 of the turn nut 120 when the bolt is installed.

Flaring anvil 210 has a through hole 212 oriented perpendicular to the central axis of the installation head, positioned between the proximal end 214 and the distal end 216 of the anvil 210. The through hole is sized to accommodate the shoulder bolt shaft 144. The distal end 216 of anvil 210 is formed to aid in flaring the end of a panel fastener outward. Flange 218 extends radially outward and aids in maintaining alignment of the anvil inside forming tube 180, thus ensuring that the anvil motion is axial and that fastener flange 18 is flared symmetrically.

Figure 3:
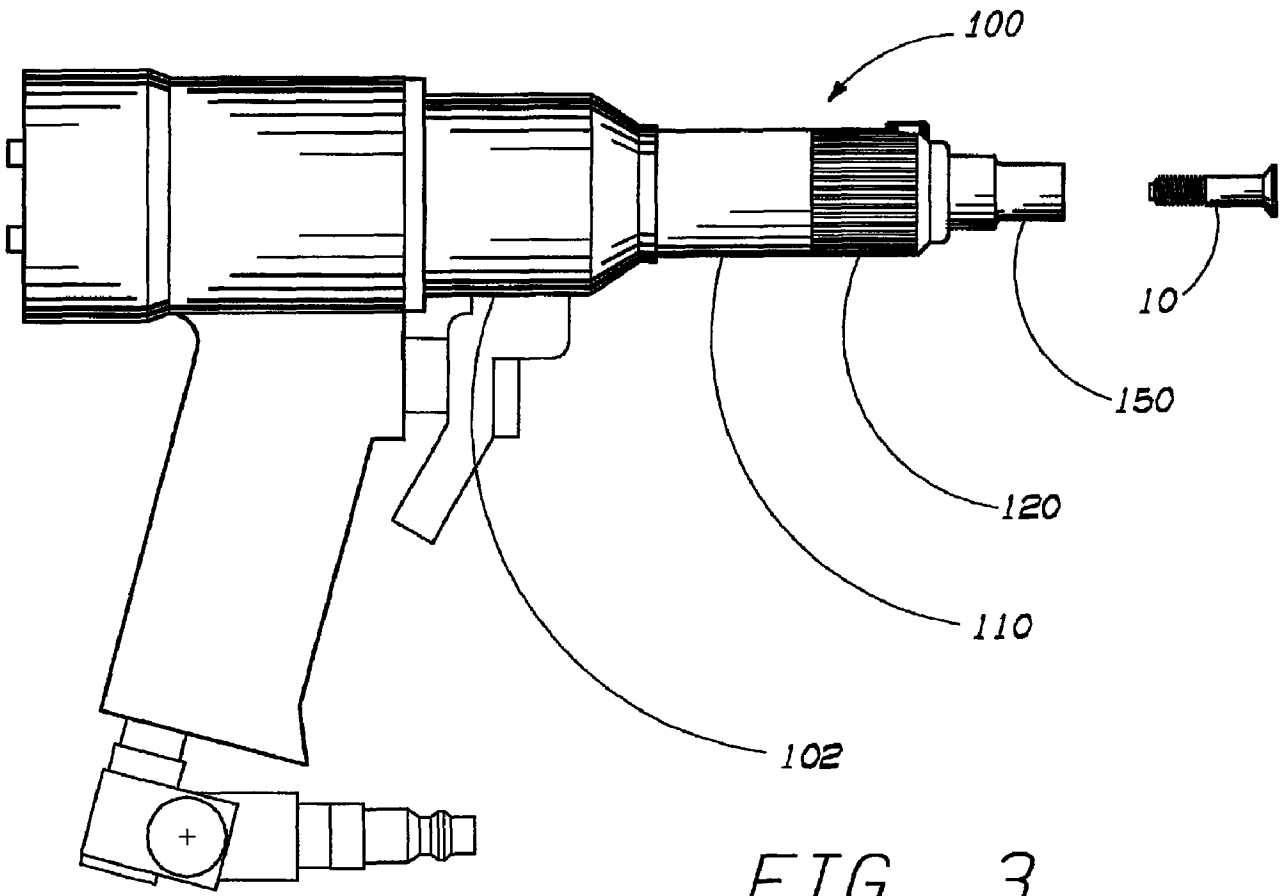
FIG. 3 is a side view of a pulling tool with head mounted onto it in accordance with the present invention.
Figure 4:
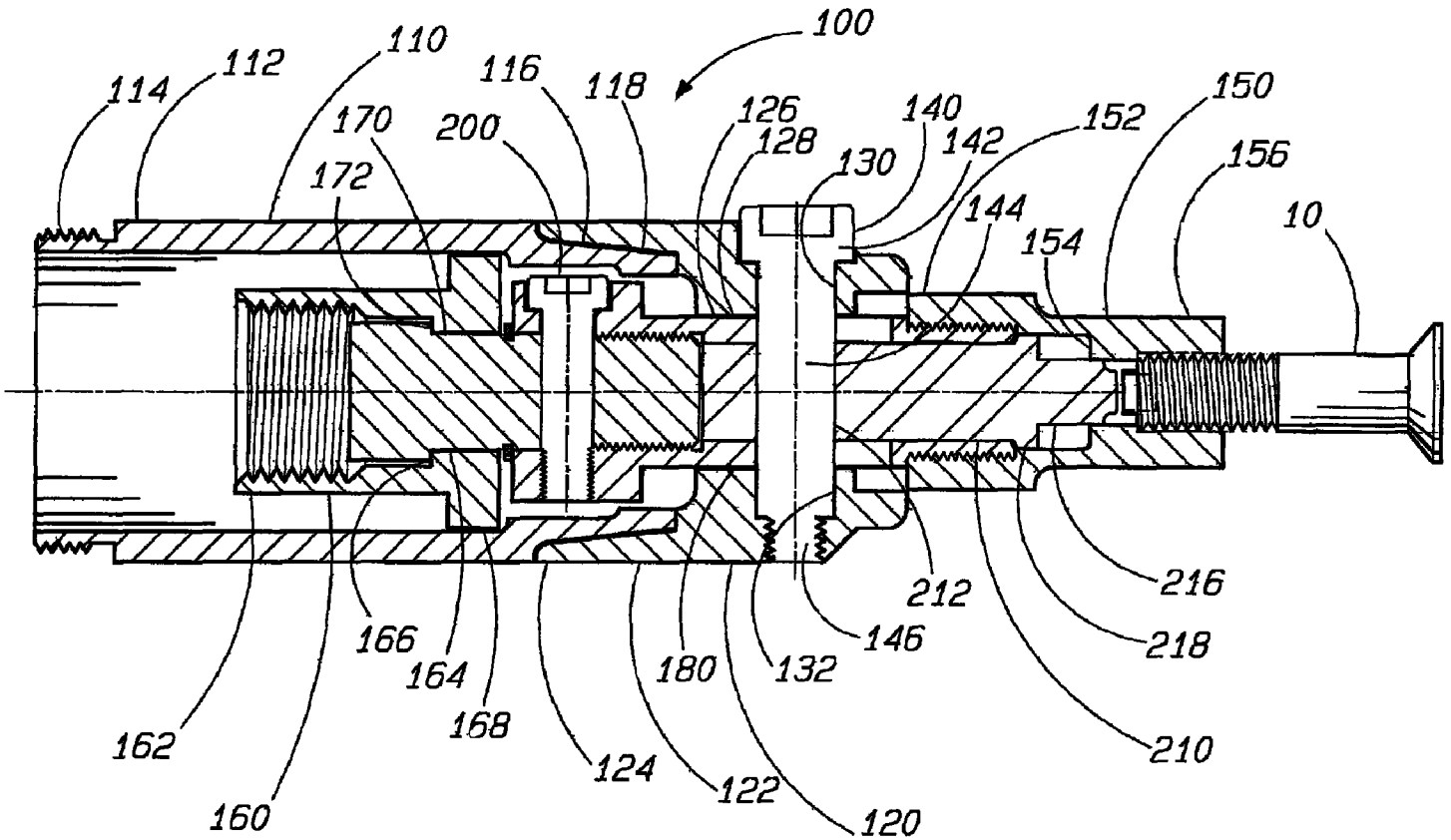
FIG. 4 is a cross sectional view of the pulling head of FIG. 3, prior to operation, with the anvil retracted relative to the threaded bushing.
Figure 5:
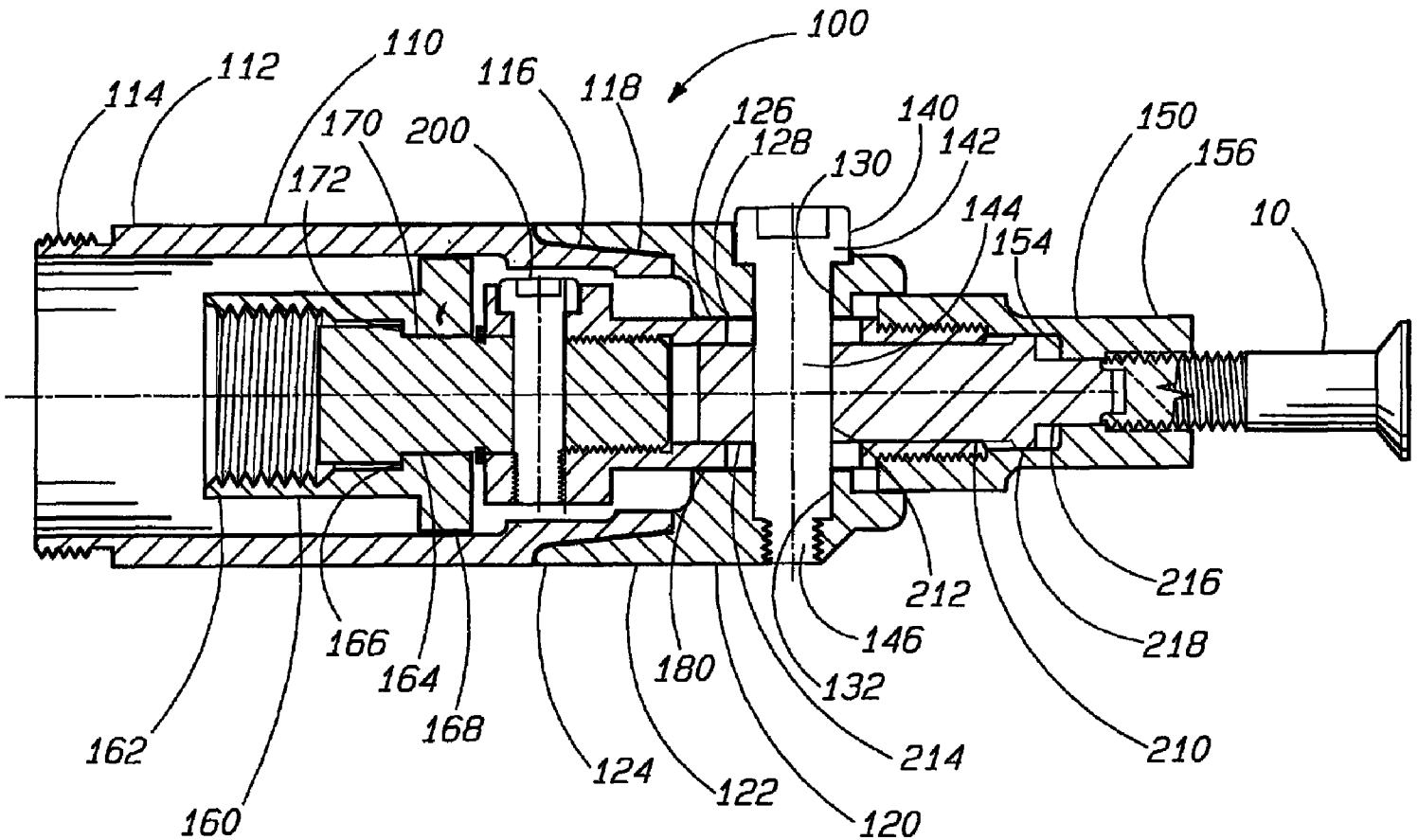
FIG. 5 is a cross sectional view of the pulling head of FIG. 3, after to operation, with the anvil extended relative to the threaded bushing and extending into a panel fastener.
Figure 6:
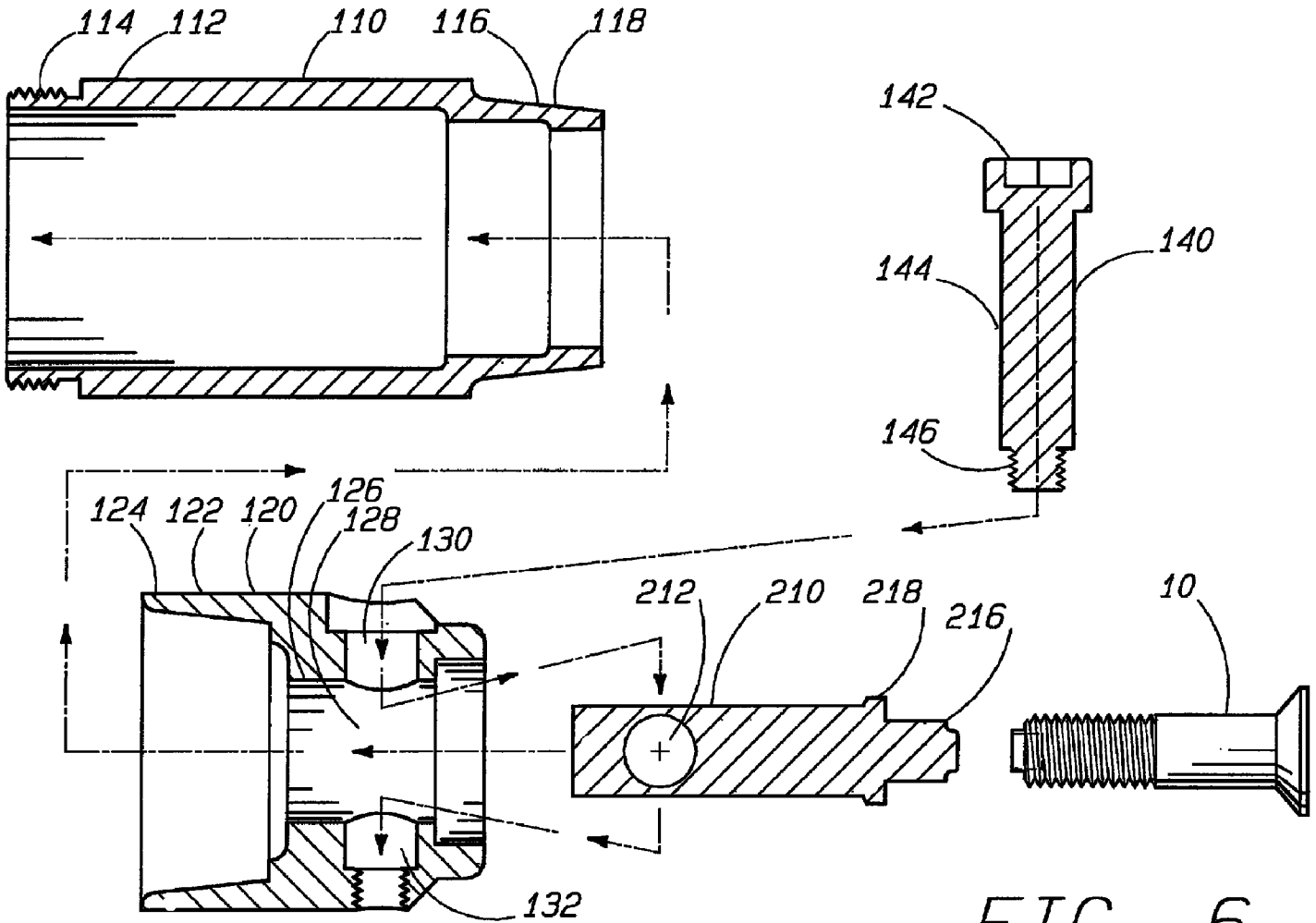
FIG. 6 is an exploded cross sectional view of the compressive components of the head assembly of FIG. 3.
Figure 7:
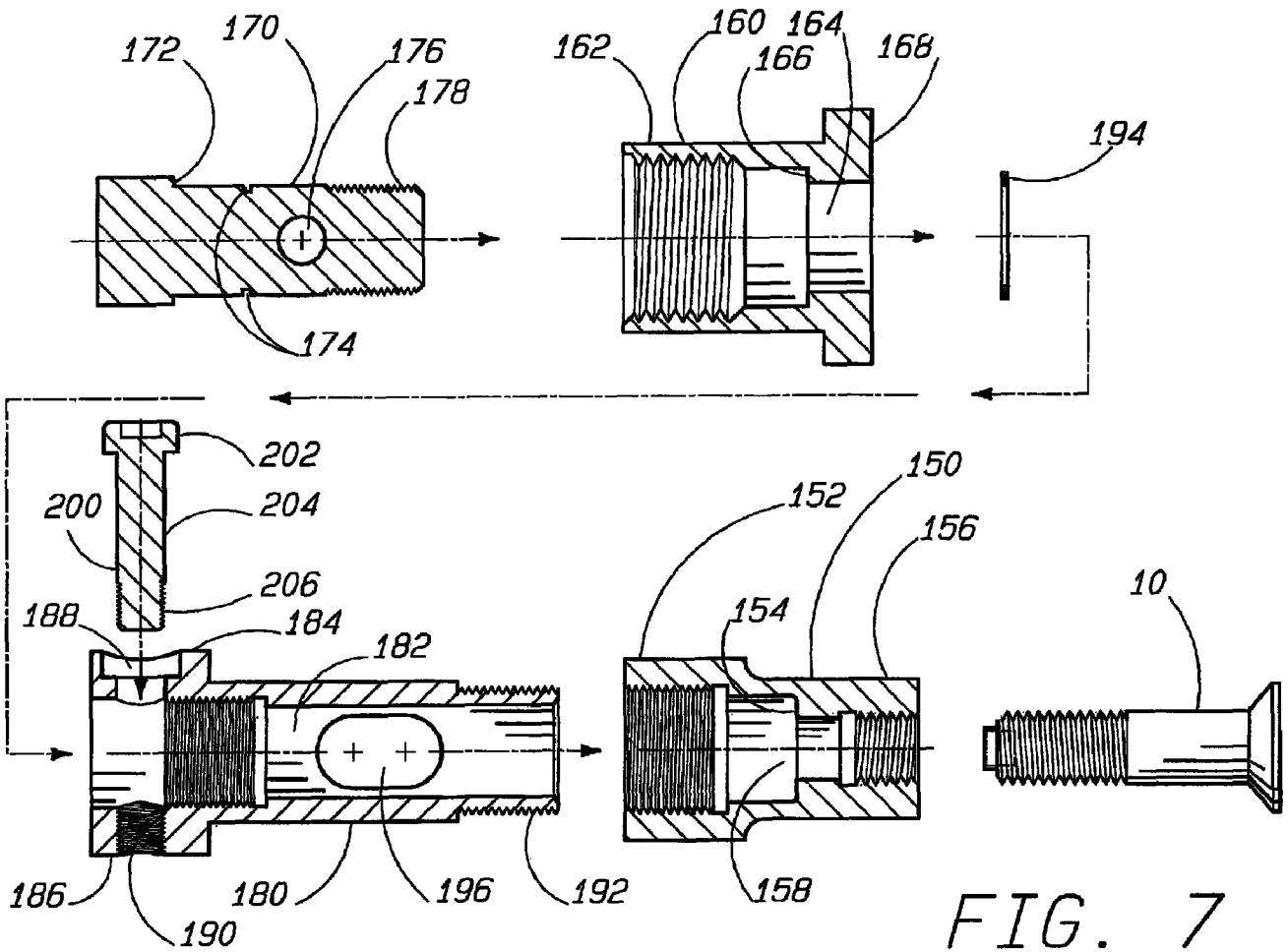
FIG. 7 is an exploded cross sectional view of the tensile components of the head assembly of FIG. 3.

Shaft holder 160 has a proximal end 162 that engages the pulling device of the installation tool for application of tensile force. As shown in FIGS. 3-5, proximal end 162 of shaft holder 160 is internally threaded to mate with the pulling device of a PT-100M tool. Shaft holder 160 has an axial bore 164 extending therethrough, with an internal shoulder 166 adjacent the distal end 168 of the shaft holder 160. Shaft holder 160 is slideable reciprocally and axially inside the outer sleeve 110.

Shaft 170 has a wider diameter proximal end with a shoulder 172 that acts as a stop for distal axial motion when shaft shoulder 172 contacts internal shaft holder shoulder 166. Shaft 170 includes indentations 174 and a through hole 176 near its distal end 178 and is rotatable inside shaft holder 160.

Forming tube 180 has an axial bore 182 and a larger diameter flange 184 at its proximal end 186. Opposing holes 188 and 190 pass through the forming tube 180, with hole 188 countersunk to accommodate the head of socket bolt 200 while allowing axial motion of the forming tube 180 and the socket bolt 200 within sleeve 110. Hole 190 is threaded to mate with the socket bolt 200. The distal end 192 of forming tube 180 is adapted for engagement with the threaded bushing 150, shown with external threads. Clip 194 fits into indentations 174 and positions the forming tube 180 onto shaft 170 for interfacing with the other pulling head components. Low head socket bolt 200 secures the forming tube 180 onto shaft 170. It should be noted that the shaft 170, the forming tube 180, and the threaded bushing 150, which cooperate as a tensile force assembly, are freely rotatable within the shaft holder 160, which is secured to the puller shaft of the installation tool. Slots 196 in forming tube 180 provide for axial motion of shoulder bolt 140 relative to the forming tube 180. This tensile force assembly is rotatable by the turn nut 120 to thread onto, or off of, the captive fastener during installation, even though the turn nut 120 is a compressive member in the head assembly. The clip 194 is located slightly distally of the distal end of shaft holder 160 to allow rotation of the tensile assembly components within the shaft holder 160.

Socket bolt 200 has a head 202, a shaft 204, and a threaded end 206. Head 202 fits into hole 188 of forming tube, shaft 204 fits through hole 176 of shaft 170, and threaded end 206 engages internally threaded hole 190 of forming tube 180 to join shaft 170 to forming tube 180.

Threaded bushing 150 has a proximal end 152 adapted for attachment to the distal end of forming tube 180, shown with internal screw threads. An axial bore 158 extends through bushing 150, with a shoulder 154 that extends internally to act as a stop for distal axial motion of the flaring anvil. The distal end 156 of the threaded bushing 150 is internally threaded to accommodate the threaded shank of a panel fastener 10.

In operation, the shaft 160 slides axially and reciprocally inside the shaft holder 170, with the shoulder 172 of shaft 170 providing a stop for shoulder 166 of shaft holder 160. Socket bolt 200 attaches the forming tube 180 to the shaft 170, so the forming tube 180 moves axially along with the shaft 170 and transfers tensile force from the tool to the threaded bushing 150 and captive panel fastener 10. Holes 130 and 132 in the turn nut 120 accommodate the shoulder bolt 140. Slots 196 of forming tube 180 allow for reciprocal axial motion of shoulder bolt 140 relative to forming tube 180, while at the same time transferring compressive forces via the shoulder bolt 140 to the flaring anvil 210 through hole 212 in the flaring anvil. The slots 196 must extend far enough axially to provide for sufficient travel of the shoulder bolt 140 and the flaring anvil 210 to provide adequate deformation of flange 18 of captive fastener 10 to retain the pronged washer 24 on the fastener 10.

The components of head 100 can be formed from any suitable material that can be formed with sufficient precision, withstand the forces applied during installation of panel fasteners, and stand up to repeated use. Examples of suitable materials include heat treated steels and stainless steels hardened to a Rockwell hardness suitable to withstand flaring pressures repeatedly. Preferably, the selected alloys should have a hardness sufficient to withstand repeated applications of tensile and compressive forces up to about 4,000 pounds, such as a hardness of about 38-40 Rc. Preferably, the anvil is operative to apply upset forces between about 1000 psi and 4000 psi to the end of the panel fastener, depending on the size of the panel fastener, with an anvil hardness of about 60-61 Rc.

The flaring anvil and the threaded bushing are sized to accommodate desired type of fastener. The proximal ends of the shaft holder and the sleeve should be compatible with the installation tool to be used. It should be noted that the internal and external screw threads described above match the accompanying drawings, but the components could have the internal and external threads reversed on mating components, or other suitable means could be used to join components instead of screw threads.

To mount the head assembly components onto an installation tool, first the tensile components of head assembly 100 are attached to each other. The shaft 170 is inserted into the axial bore 164 of shaft holder 160 so that adjacent shoulders 172 and 166 are in contact. Then clip 194 is installed into indentation 174, thus affixing shaft 170 to shaft holder 160. Forming tube 180 is then threaded onto the distal end of shaft 170 until it is positioned against clip 194. When the forming tube 180 is positioned on shaft 170, low head socket bolt 200 is inserted onto holes 188 and 190 in the forming tube 180 and through hole 176 in the shaft 170. The bolt 200 is then tightened to secure the forming tube 180 to the shaft 170. This tensile assembly is then secured to the puller shaft of the fastener installation tool.

Then the sleeve 110 is positioned around the tensile assembly and attached to the compressive element of the fastener installation tool. After sleeve 110 is in place, the turn nut 120 is positioned onto the distal end of the sleeve 110 by fitting the axial bore 128 of the turn nut 120 over the forming tube 180. Then, the flaring anvil 210 is positioned within the forming tube 180 with the distal end 216 most forward. The openings 130 and 132 of the turn nut 120, slots 196 of the forming tube 180, and hole 212 through flaring anvil 210 are aligned, and shoulder bolt 140 is inserted and threaded into place. Finally, the threaded bushing 150 is screwed onto the distal end 192 of the forming tube 180, using a thread locking adhesive and a set screw (not shown), which is part of the threaded bushing 150. It should be noted that the flaring anvil 210 and the threaded bushing 150 should be selected for compatibility with the thread size and diameter of the fastener(s) to be installed.

As shown and described herein, the components are formed for use with a PT-100M installation tool. However, the components, particularly the proximal ends of the shaft holder and sleeve, could be formed for compatibility with a any suitable fastener installation tool.

To use pulling head 100, the shank of a new panel fastener, such as fastener 10, with an undeformed shank end 22, is inserted through a hole in the panel to which it is to be mounted. The pronged washer 24 is positioned around the fastener shank 14. The fastener 10 is then threaded into the distal end of the threaded bushing 150, with the head assembly 100 attached to the installation tool. While holding the turn nut fast, such as between the user's thumb and index finger, a TORX driver or other appropriate tool is used to screw the fastener 10 into the threaded bushing 150 until the fastener 10 stops threading in due to the fastener end 22 contacting the distal end 216 of the flaring anvil 210. The proper position of the fastener end 22 is indicated by the turn nut 120 being forced to its most proximal position against the sleeve 110. If the captive fastener 10 is screwed all the way into the distal end 156 of threaded bushing 150, the motion of the compressive elements of the head 100 relative to the tensile components provides for the proper range of axial motion to flare fastener flange 18 appropriately.

To flare the end of the panel fastener, the trigger of the installation tool is pulled and held for a period of time sufficient to flair the end of the fastener 10, typically about three to four seconds. Preferably, the trigger is pulled only once for each fastener, thus avoiding the problems encountered when the work hardened fastener end is subsequently further deformed. After the installation tool trigger is released, the fastener can be removed from the threaded bushing 150. The flared end 22 of the fastener 10 retains the washer 24 on the fastener shank 14, preventing removal of the fastener from the panel.

When the trigger is pulled, the part of the installation tool that provides compressive force drives the sleeve 110 into the turn nut 120. The turn nut 120 is coupled to the anvil 210 via shoulder bolt 140, so the compressive load is in turn applied to the anvil 210 to flair the end 22 of the panel fastener 10. The tool puller shaft; shaft holder 160; shaft 170 and forming tube 180, held together by socket bolt 200; and threaded bushing 150 remain stationary, providing tension to the fastener 10 as the anvil 210 is advanced distally, with shoulder bolt 140 moving distally in slots 196 of the forming tube 180. The fastener flange 18 is flared symmetrically outward, sufficiently far to retain pronged washer 24 on the fastener shank 14, but not so far as to interfere with unscrewing fastener from the threaded bushing or screwing the fastener into a nut or threaded hole for use to secure a panel in place.

Because the installation tool can be adjusted to provide predetermined and controlled compressive and tensile forces that are appropriate for flaring the end of the desired captive panel fastener, installation of a fastener can be accomplished with a single stroke of the tool, ie, a single use of the tool's trigger. Thus, the industry-recognized problems previously encountered with manual installation tools requiring multiple tool strokes are avoided. These problems include damage to the deformed flange during a second tool stroke of the hand-operated tool and resultant failure of the fastener, as well as fatigue and repetitive motion injuries experienced by installers.

Further, the time required to install a fastener using the head assembly of the present invention is much shorter, mostly because the first installation operation is also the last. Using the prior art hand tool, the installer usually has to check the flare of the fastener and test to see if the pronged washer will stay on. It the pronged washer can be removed from the fastener, then the fastener must be reinstalled into the tool, and the tool must be operated a second or even a third time to make sure the flare is sufficient. Because the fastener is work hardened during the first pressure application, the fastener is subject to failure with the second or third pressure application.

The foregoing description is considered as illustrative only of the principles of the invention. Further, since numerous modifications and changes will readily occur to those skilled in the art, it is not desired to limit the invention to the exact construction and process shown and described above. Accordingly, all suitable modifications and equivalents may be resorted to falling within the scope of the invention.

List of numbered features

Figure 2:
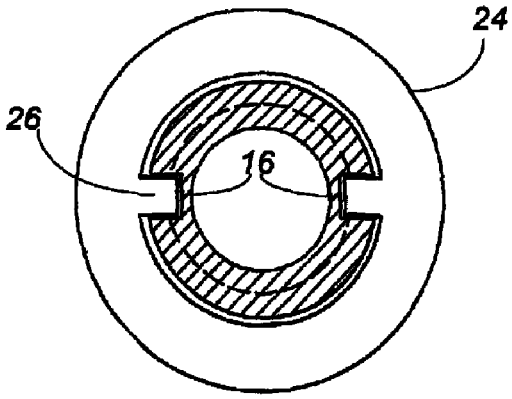
Fig. 2 Prior Art
FIG. 2 is across sectional view of the prior art captive panel fastener of FIG. 1 along line A-A, adapted from FIG. 3 of U.S. Pat. No. 4,655,658 to Bulent Gulistan, issued on Apr. 7, 1987.

FIGS. 1-2 (prior art) (U.S. Pat. No. 4,655,658)
captive panel fastener 10
head 12
threaded shank 14
grooves 16
flange 18 that can be deformed
axial bore 20
end 22
washer 24
prongs 26
FIGS. 3-5
panel fastener installation head 100
installation tool 102
sleeve 110
proximal end 112 of sleeve -continued

| List of numbered features |
| --- |
| external screw threads 114 |
| distal end 116 of sleeve |
| external surface 118 |
| turn nut 120 |
| outer surface 122 of turn nut |
| proximal end 124 of turn nut 120 |
| internal surface 126 of turn nut |
| axial bore 128 through turn nut |
| openings 130 and 132 extend through turn nut |
| shoulder bolt 140 |
| head 142 of shoulder bolt |
| shaft 144 of shoulder bolt |
| threaded end 146 |
| threaded bushing 150 |
| proximal end 152 of threaded bushing |
| shoulder 154 inside threaded bushing |
| distal end 156 of the threaded bushing |
| axial bore of threaded bushing 158 |
| shaft holder 160 |
| proximal end 162 of shaft holder |
| axial bore 164 of shaft holder |
| internal shoulder 166 of shaft holder |
| distal end 168 |
| Shaft 170 |
| shoulder 172 of shaft 170 |
| indentations 174 |
| through hole 176 |
| distal end 178 of shaft |
| forming tube 180 |
| axial bore 182 of forming tube |
| flange 184 of forming tube |
| proximal end 186 of forming tube |
| holes 188 and 190 in forming tube |
| distal end 192 of forming tube |
| clip 194 |
| slots 196 |
| socket bolt 200 |
| head 202 of socket bolt |
| shaft 204 of socket bolt |
| threaded end 206 of socket bolt |
| flaring anvil 210 |
| through hole 212 in anvil |
| proximal end 214 of the anvil |
| distal end 216 of the anvil |
| flange 218 |

I claim:

1. A panel fastener head assembly for installing captive panel fasteners into holes in a panel, said head assembly comprising:

means for transferring a predetermined outer axial compressive force to an anvil; said anvil adapted for flaring the end of a captive panel fastener; and means for transferring a predetermined inner axial tensile force to a bushing outside of and coaxial with said anvil; said bushing adapted for retaining a shank of a captive panel fastener;

wherein:

said head assembly is combinable with a fastener installation tool, the tool having a pulling device for providing said axial tensile force and a pushing device for providing said outer axial compressive force distributed about said inner axial tensile force; and said means for transferring an outer axial compressive force is slidable axially and reciprocally relative to said means for transferring an inner axial tensile force.

2. The panel fastener head assembly of claim 1, wherein:

said anvil has a proximal portion with at least one opening therethrough and a distal end with a flaring portion; and said means for transferring said outer axial compressive force further comprises:

a sleeve having a proximal end mateable with said pushing device of said installation tool;

a turn nut mated with a distal end of said sleeve; and a shoulder bolt extending through openings in said turn nut and through the at least one opening of said anvil.

3. The panel fastener head assembly of claim 1, wherein:

said means for transferring said inner tensile force further comprises:

a shaft holder having a proximal end mated with the pulling device of the tool, an axial passage therethrough, and an internal shoulder extending radially inward into the passage;

a shaft having a proximal end adapted for retention inside the passage of said shaft holder with said proximal end positioned proximally relative to said shoulder, said shaft also having a distal end;

a forming tube extending distally from said distal end of said shaft and having a distal end and slots passing therethrough with elongations substantially parallel to said axial forces; and a socket bolt joining said forming tube to said shaft; and said bushing has a proximal end mated with said distal end of said forming tube and a distal, internally threaded end formed to accommodate the shank of a captive panel fastener.

4. A tool for installing captive panel fasteners, said tool comprising:

means for providing a predetermined axial compressive force distributed about a predetermined inner axial tensile force; and a panel fastener head assembly for use with a fastener installation tool;

wherein said head assembly comprises:

means for transferring said predetermined outer axial compressive force to an anvil; said anvil adapted for flaring the end of a captive panel fastener; and means for transferring said predetermined inner axial tensile force to a bushing outside of and coaxial with said anvil; said bushing adapted for retaining a shank of a captive panel fastener.

5. The tool of claim 4, wherein:

said anvil has a proximal portion with at least one opening therethrough and a distal end with a flaring portion; and said means for transferring said outer axial compressive force further comprises:

a sleeve having a proximal end mateable with said pushing device of said installation tool;

a turn nut mated with a distal end of said sleeve; and a shoulder bolt extending through openings in said turn nut and through the at least one opening of said anvil.

6. The tool of claim 4, wherein:

said means for transferring said inner tensile force further comprises:

a shaft holder having a proximal end mated with the pulling device of the tool, an axial passage therethrough, and an internal shoulder extending radially inward into the passage;

a shaft having a proximal end adapted for retention inside the passage of said shaft holder with said proximal end positioned proximally relative to said shoulder, said shaft also having a distal end;

a forming tube extending distally from said distal end of said shaft and having a distal end and slots passing therethrough with elongations substantially parallel to said axial forces; and a socket bolt joining said forming tube to said shaft; and a bushing, said bushing having a proximal end mated with said distal end of said forming tube and a distal, internally threaded end formed to accommodate a shank of a captive panel fastener.

7. A method for installing a captive panel fastener into a hole passing through a panel, said method comprising the steps of:

a) providing a tool for installing captive panel fasteners, wherein:

said tool comprises a panel fastener head assembly for use with a fastener installation tool;

said tool is operative to provide a predetermined outer axial compressive force distributed about a predetermined inner axial tensile force; and said head assembly comprises:

means for transferring said outer axial compressive force to an anvil; said anvil adapted for flaring the end of a captive panel fastener; and means for transferring said inner axial tensile force to a bushing outside of and coaxial with said anvil; said bushing adapted for retaining a shank of a captive panel fastener;

b) inserting a captive panel fastener shank through the hole in the panel;

c) placing a pronged washer onto the shank;

d) joining said panel fastener shank to said bushing; and e) using said tool to apply simultaneously said predetermined outer axial compressive force that is transferred to said anvil and said predetermined inner tensile force that is transferred to said bushing and panel fastener.

8. The method of claim 7, wherein said fastener is installed using a single tool stroke.

9. The method of claim 7, wherein:

said anvil has a proximal portion with at least one opening therethrough and a distal end with a flaring portion;

said means for transferring said outer axial compressive force further comprises:

a sleeve having a proximal end mateable with said pushing device of said installation tool;

a turn nut mated with a distal end of said sleeve; and a shoulder bolt extending through openings in said turn nut and through the at least one opening of said anvil; and said using step comprises transferring said outer axial compressive force to said anvil via said sleeve, said turn nut, and said shoulder bolt.

10. The method of claim 7, wherein:

said means for transferring said inner tensile force further comprises:

a shaft holder having a proximal end mated with the pulling device of the tool, an axial passage therethrough, and an internal shoulder extending radially inward into the passage;

a shaft having a proximal end adapted for retention inside the passage of said shaft holder with said proximal end positioned proximally relative to said shoulder, said shaft also having a distal end;

a forming tube extending distally from said distal end of said shaft and having a distal end and slots passing therethrough with elongations substantially parallel to said axial forces; and a socket bolt joining said forming tube to said shaft; and a bushing, said bushing having a proximal end mated with said distal end of said forming tube and a distal, internally threaded end formed to accommodate a shank of a captive panel fastener; and said using step comprises transferring said inner axial tensile force via said shaft holder, said shaft, said forming tube, said socket bolt, and said bushing.

* * * * *